United States Patent [19]

Mongoven et al.

[11] Patent Number: 4,912,372

[45] Date of Patent: Mar. 27, 1990

[54] POWER CIRCUIT FOR SERIES CONNECTED LOADS

[75] Inventors: Michael A. Mongoven, Oak Park; James P. McGee, Chicago, both of Ill.

[73] Assignee: Multi Electric Mfg. Co., Chicago, Ill.

[21] Appl. No.: 276,580

[22] Filed: Nov. 28, 1988

[51] Int. Cl.[4] ..... H05B 37/00; H05B 41/00; H05B 41/16; H05B 41/24

[52] U.S. Cl. ..... 315/122; 315/256; 315/257; 315/121; 315/185 R; 315/250; 315/254; 315/255; 315/277; 315/288; 315/31.2; 307/17; 307/36

[58] Field of Search ..... 315/256, 257, 122, 119, 315/121, 185 R, 246, 250, 254, 255, 277, 282, 288, 312, 76; 307/17, 36

[56] References Cited

U.S. PATENT DOCUMENTS

| | | | |
|---|---|---|---|
| 342,552 | 5/1886 | Westinghouse, Jr. | 315/256 |
| 1,024,495 | 4/1912 | Booth et al. | 315/123 |
| 1,466,110 | 8/1923 | Beckwith et al. | 315/256 |
| 1,660,680 | 2/1928 | Miller et al. | 315/76 |
| 1,664,170 | 3/1928 | Hendry | 315/76 |
| 2,066,928 | 1/1937 | Davis | 315/76 |
| 2,095,306 | 10/1937 | Austin | 315/254 |
| 2,292,064 | 8/1942 | Dorgelo et al. | 315/256 |
| 2,809,329 | 10/1957 | Stier . | |
| 3,454,780 | 7/1969 | Cominassi et al. | 307/17 |
| 3,531,765 | 9/1970 | Christianson et al. | 315/76 |
| 3,639,805 | 2/1972 | Muench et al. | 315/185 R |
| 3,969,649 | 7/1976 | Jacob | 315/78 |
| 4,006,412 | 2/1977 | Campbell et al. . | |

*Primary Examiner*—Eugene R. LaRoche
*Assistant Examiner*—Michael B. Shingleton
*Attorney, Agent, or Firm*—Wood, Phillips, Mason, Recktenwald & Vansanten

[57] ABSTRACT

A power circuit for N series connected loads according to the present invention includes N transformers having primary windings connected in series across a constant current AC source and secondary windings connected in series with the N loads. N−1 conductors are coupled from a junction between the loads to a corresponding junction between the secondary windings. Failure of one of the loads resulting in an open circuit will not interrupt power to the remaining loads.

9 Claims, 2 Drawing Sheets

POWER CIRCUIT FOR SERIES CONNECTED LOADS

TECHNICAL FIELD

The present invention relates to power circuits, and more particularly to a power circuit for series connected loads.

BACKGROUND ART

In many power circuit applications having series connected loads it is desirable to provide a means wherein failure of one of the loads resulting in an open circuit will not interrupt the power to the remaining loads.

An example of an application is an airport lighting system wherein the loads are lamps located atop towers.

A circuit wherein lamps are connected in series and remotely located from a power source requires only two wires to connect the lamps to the power source. However, failure of a lamp resulting in an open circuit will interrupt the operation of the circuit. To avoid this problem, many circuits have incorporated various forms of shorting circuits which shunt each lamp. When a lamp fails resulting in an open circuit, the shorting circuit is activated and places a short across the failed lamp thereby completing the circuit and allowing current to flow to the remaining lamps. Booth et al U.S. Pat. No. 1,024,495 and Stier U.S. Pat. No. 2,809,329 disclose series connected lamps shunted by normally open shorting circuits. However, use of present mechanically held shorting devices in airport lighting systems is expensive and the failure rate of such shorting devices is relatively high.

Isolation transformers are typically used to distribute power from a main power source to the lamps. To avoid the cost and high failure rate of present shorting circuits, each lamp may be connected to a different isolation transformer secondary winding. The transformer primary windings are connected in series to the main power source. In this circuit, each lamp is connected to a transformer secondary winding by two conductors. In the event a lamp fails resulting in an open circuit, the power to the other lamps is not interrupted.

However, one disadvantage of this circuit can be seen where the lamps are located atop approach towers. Such towers must be frangible to enable the tower to collapse under impact from a plane in flight to minimize damage to the plane and injury to occupants therein. In this circuit, 2N wires must be run up the tower, where N is the number of lamps. Such a large number of wires results in a less frangible tower.

Another disadvantage is that a larger number of wires increases the cost. This is apparent when the height of the tower is taken into consideration. If five lamps are located atop the tower, for example, the circuit would require ten wires extending to the top of the tower.

Another power circuit arrangement is shown in Jacob U.S. Pat. No. 3,969,649. Jacob discloses a bicycle lighting system including two lamps connected in series across a winding of a dynamo. An impedance is connected between an internal tap of the winding and a junction point between the lamps. The impedance is selected to establish system equilibrium whereby the lamp junction point and tap are maintained at the same potential under normal operating conditions despite variations in dynamo and lamp resistance with bicycle speed. If a lamp fails resulting in an open circuit, the power to the remaining lamp is not interrupted.

This Jacob circuit eliminates the need for shorting devices shunting each lamp. However, the dynamo winding and impedance must be selected for a given set of lamps having particular electrical ratings. If one or both lamps are exchanged for a lamp having a different electrical rating, the system equilibrium will be offset. Thus, the impedance and/or dynamo must be replaced by a different impedance and dynamo to reestablish system equilibrium.

SUMMARY OF THE INVENTION

In accordance with the present invention, a power circuit for series connected loads which continues to energize operative loads after failure of one or more of the loads requires relatively few wires to connect the loads to a source of power.

More particularly, a power circuit for N series connected loads includes N transformers having primary windings connected in series across a constant current AC source and secondary windings connected in series with each other and with the N loads. $N-1$ conductors are coupled from a junction between the loads to a corresponding junction between the secondary windings. Preferably, the conductors have substantially zero impedance at an operating frequency.

In the preferred embodiment wherein the loads are lamps, a failure of one of the lamps resulting in an open circuit will not interrupt power to the remaining lamps. This is accomplished without the need or expense of shorting circuits or impedances.

Further, a failure of a lamp as described above, will not change the power distribution to the other lamps. Therefore, the other lamps will maintain the same intensity as before the failure of the lamp.

In addition, only $N+1$ wires are required to connect the lamps to a power source. Where the lamps are remotely located, a great benefit is derived from the reduced number of wires in the form of cost savings, logistics of routing fewer wires to the loads and a reduction in weight.

The benefits of routing fewer wires to the lamps are especially seen where the power circuit is incorporated in an airport lighting system. If the lamps are located atop an approach tower, it is desirable to keep the number of wires connecting the lamps to a minimum for the reasons associated with frangibility and cost as discussed above.

In addition, the power circuit may be advantageously used in other airport applications. For example, the power circuit could be used with lamps not mounted on a tower, e.g. lamps which are used to guide the pilot on a runway and/or taxiway.

Further, the present invention provides a power circuit wherein lamps of different electrical ratings may be used together, if desired. In the event a lamp is to be substituted for a lamp having a different electrical rating, only the lamp and perhaps the corresponding transformer need be replaced to obtain the desired lamp intensity.

BEST MODE FOR CARRYING OUT THE INVENTION

Figure 1:
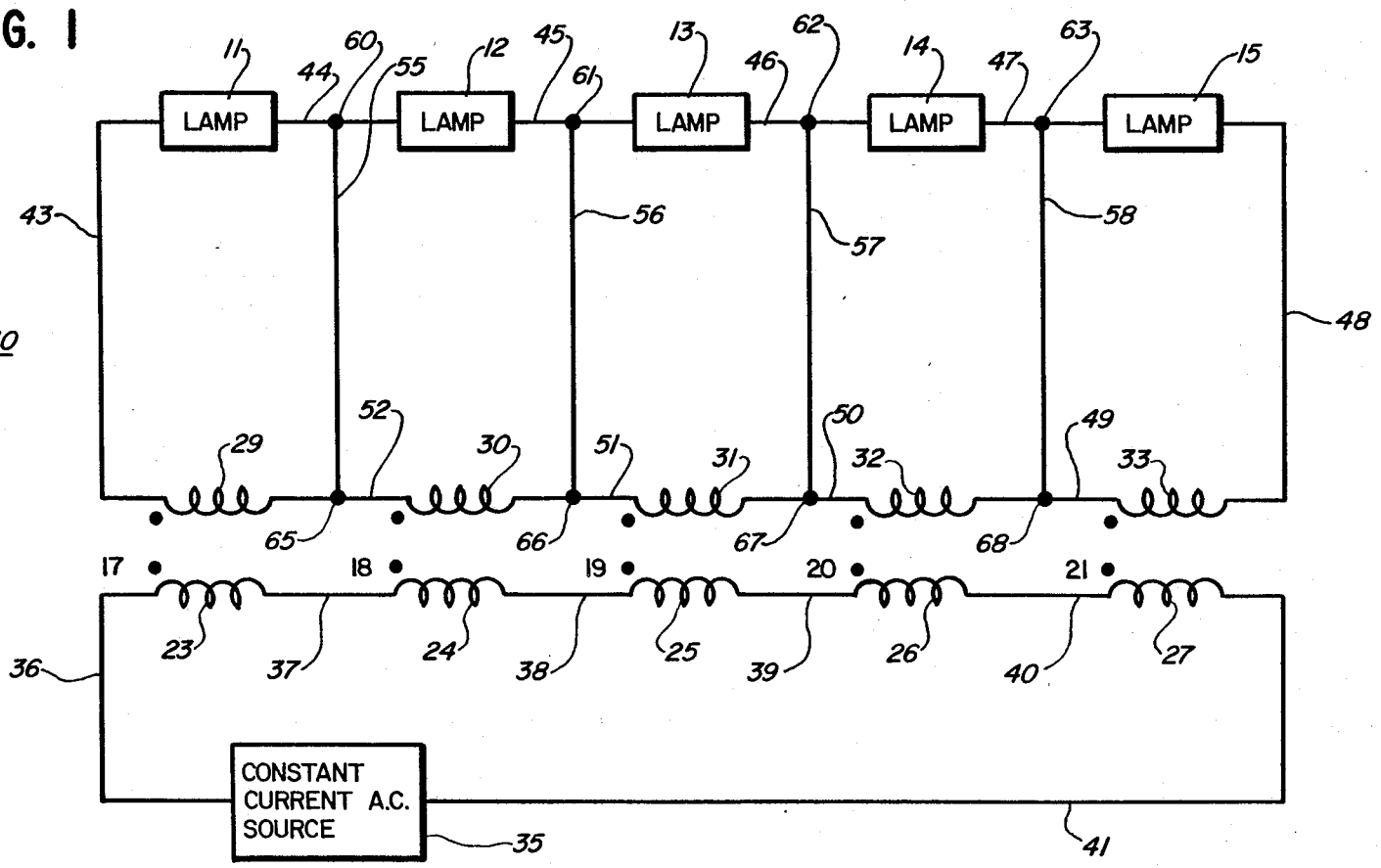
FIG. 1 is a combination block diagram and schematic of a power circuit for N series connected lamps according to the present invention where N is five.

Referring to FIG. 1, there is illustrated a schematic of a power circuit 10 for N series connected lamps 11-15, where N is five, in accordance with the present invention. A series of N transformers 17-21 are shown consisting of primary windings 23-27 and secondary windings 29-33, respectively. A constant current AC source 35 is connected in series with the primary windings 23-27 through conductors 36-41.

The secondary windings 29-33 are connected in series with each other and with the lamps 11-15 through conductors 43-52. N-1 conductors 55-58 are coupled from one of junctions 60-63 between the lamps 11-15 to one of a series of corresponding junctions 65-68. The AC source 35 provides a constant current to the primary windings 23-27 of the transformers 17-21. The transformers 17-21 are individually selected for specific electrical characteristics according to the electrical ratings of the corresponding lamps 11-15 to establish the proper intensities for the lamps 11-15. The current flowing in the primary windings 23-27 causes corresponding currents to flow in the secondary windings 29-33 wherein the secondary currents are dependent upon the turns ratios of the transformers 17-21. The phasing of each transformer, i.e., the direction of current flow in each secondary winding, is denoted by the polarity markings of FIG. 1.

The circuit illustrated in FIG. 1 will initially be described under the assumption that the lamps are to operate at equal intensities. In order for this condition to be satisfied, the lamps 11-15 and transformers 17-21 must have matching electrical ratings and the turns ratios of the transformers 17-21 must be equal so that the currents through the lamps 11-15 are equal.

The constant current developed by the constant current AC source 35 flows through each of the primary windings 23-27 of the transformers 17-21. Since the turns ratios of the transformers 17-21 are equal, equal currents are induced in the secondary windings 29-33. The current induced in each secondary winding 29-33 flows in a loop associated therewith including an associated lamp 11-15, respectively. For example, the current induced in the winding 29 flows through the lamp 11 and the conductors 43 and 55. Thus, with the transformer phasing illustrated in FIG. 1, currents of equal magnitude and opposite direction flow in the conductors 55-58, resulting in substantially no net current flow therein, assuming that all of the lamps 11-15 are operational. Each lamp 11-15 receives the current developed by its associated secondary winding 29-33, respectively, and hence the lamps burn at equal intensities.

If one of the lamps, for example the lamp 13, burns out so that an open circuit results between junctions 61 and 62, currents continue to flow through each of the lamps 11, 12, 14 and 15. These currents are at the same amplitude as before failure of the lamp 13, inasmuch as the AC source provides a constant current to each of the primary windings 23-27, thus insuring that the currents induced in the secondary windings 29, 30, 32 and 33 remain constant. Thus, the lamp intensities remain equal even when one or more of the lamps 11-15 fails. However, the currents through the conductors 56 and 57 are non-zero, inasmuch as the secondary winding 31 of the transformer 19 no longer supplies current to oppose the currents produced by the secondary windings 30 and 32.

If the lamps 11-15 are not to be of equal intensities, each lamp 11-15 is paired with a transformer 17-21 of matching electrical rating. For example, where the lamp 11 is a 6.6 amps device, the transformer 17 is designed so that the secondary winding 29 provides such current level. If the remaining lamps 12-15 are, for example, 20 amp devices, the phasing shown in FIG. 1, the currents through the conductors 56-58 are substantially zero whereas the current through the conductor 55 is equal to 13.4 amps (i.e. the 20 amps provided by winding 30 less the 6.6 amps provided by winding 29). Again, if any of the lamps 11-15 fails, the remaining, operative lamps continue to receive the same magnitude of current as before the failure, thereby maintaining the intensities constant.

It should be noted that operation of the power circuit 10 does not require that the transformer phasing be as illustrated in FIG. 1. Direction of current flow in one or more of the secondary windings 29-33 could be reversed from that shown in the Figure. In this case, failure of one of the lamps 11-15 does not result in a change in intensity of the remaining, operative lamps. However, the amplitude of the current in one or more of the conductors 55-58 would not be zero.

For example, if the transformer 18 of FIG. 1 were phased oppositely to that shown in the Figure, current flow in the conductors 57 and 58 would be substantially zero whereas a non-zero current would flow in the conductors 55 and 56.

From the foregoing, it can be seen that in the event one of the lamps 11-15 fails resulting in an open circuit, a shorting circuit is not required to prevent interruption of power to the lamps 11-15 that have not failed.

A power circuit for N lamps, in accordance with the present invention, requires only N+1 conductors to electrically connect N transformers to the N lamps. FIG. 1 illustrates this advantage where N is equal to five. For the five lamps 11-15 only six conductors are required comprising the N−1 conductors 55-58 and conductors 43 and 48. comprising the N−1 conductors 55-58 and conductors 43 and 48. The benefits of only N+1 conductors is easily seen where the power circuit 10 is used in an airport lighting system.

Figure 2:
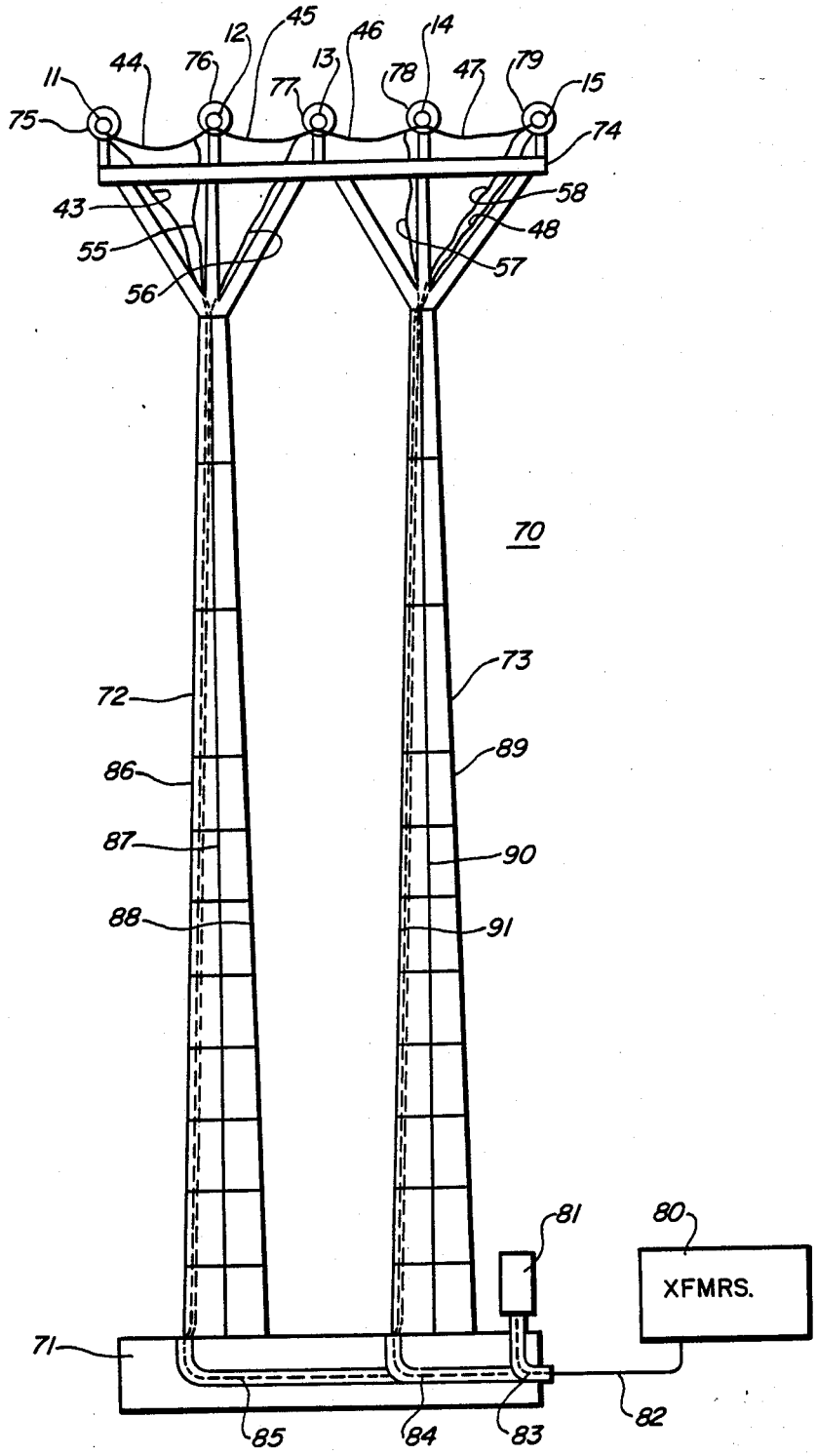
FIG. 2 is a combination elevational view, partly in section, and block diagram of an airport twin tower lighting system incorporating the present invention.

Referring now to FIG. 2, there is illustrated an airport twin tower lighting system 70 according to the present invention where N is equal to five. The lighting system 70 incorporates the power circuit 10 of FIG. 1. Where features of FIG. 1 are shown in FIG. 2 the same reference numerals have been used. The lighting system 70 is supported on a concrete base 71. Frangible towers 72 and 73 are secured to the base 71 and support a twin light crossbar 74. The crossbar 74 supports lamp fixtures 75-79 incorporating the lamps 11-15. Transformers 17-21, not shown, are located in a housing 80 and receive power from the constant current source 35, also not shown. The power is delivered by conductors 82 disposed in a channel 83 which are connected at a junction box 81 to the six conductors 43, 48 and 55-58. The conductors 43, 48 and 55-58 extend through a pair of channels 84, 85 to respective towers 72 and 73.

More specifically, from the junction box 81, the N+1 wires 43, 48 and 55-58 are separated into first and second groups of conductors. The first group of conductors consists of the three conductors 43, 55 and 56 and are routed up the tower 72 from the channel 85 between three legs 86-88. The second group of conductors comprises the conductors 48, 57 and 58 and are routed up the tower 73 from the channel 84 between three legs 89-91.

The conductors 43, 48 and 55-58 are connected to the lamps 11-15 in the fashion illustrated in FIG. 1. It is thus apparent that only N+1 conductors need be routed up the towers 72 and 73. By reducing the number of wires the frangibility is improved and hence safety is improved. Also, the cost of installing and maintaining the lighting system 70 is reduced, as compared with previous designs, as well as obtaining the remaining advantages noted hereinabove.

It should be noted that the present invention is useful in installations other than on runway towers. For example, the power circuit may be used for runway takeoff or taxiway lights mounted within or near the ground or in other lighting installations.

We claim:

1. A circuit for powering from a constant current AC source serially connected loads with a junction formed between each two adjacent loads, comprising:

a plurality of transformers, equal in number to the number of loads, each transformer having a primary winding and a secondary winding wherein the primary windings are connected in series with the constant current AC source and the secondary windings are connected serially with a junction formed between each two adjacent secondary windings, and the secondary windings connected in series with the loads;

a plurality of connectors, equal in number to one less than the number of loads, coupling each junction between two adjacent loads to a junction between two adjacent secondary windings.

2. The power circuit of claim 1 where the the transformers have matched current ratings with the loads.

3. The power circuit of claim 1 where the current ratings of the loads are identical.

4. The power circuit of claim 1 where the connectors are conductors.

5. The power circuit of claim 4 where the constant current AC source operates at a frequency where the impedance of the conductors is substantially zero.

6. A circuit for powering from a constant current AC source serially connected lamps with a junction formed between each two adjacent lamps, comprising:

a plurality of transformers, equal in number to the number of lamps, each transformer having a primary winding and a secondary winding wherein the primary windings are connected in series with the constant current AC source and the secondary windings are connected serially with a junction formed between each two adjacent secondary windings, and the secondary windings connected in series with the loads;

a plurality of connectors, equal in number to one less than the number of loads, coupling each junction between two adjacent lamps to a corresponding junction between two adjacent secondary windings.

7. The power circuit of claim 6 where the transformers are located remote from the lamps.

8. The power circuit of claim 7 where the connectors are conductors.

9. The power circuit of claim 8 where the lamps are installed on a plurality of towers and where a portion of the conductors extends up each tower.

* * * * *